US005630584A

United States Patent [19]

Seeber

[11] Patent Number: 5,630,584

[45] Date of Patent: May 20, 1997

[54] DEVICE FOR DEPOSITING PRODUCTS

[75] Inventor: Heinz G. Seeber, Ludwigshafen, Germany

[73] Assignee: Albert-Frankenthal Aktiengesellschaft, Frankenthal, Germany

[21] Appl. No.: 454,199

[22] PCT Filed: Dec. 14, 1993

[86] PCT No.: PCT/DE93/01192

§ 371 Date: Jun. 19, 1995

§ 102(e) Date: Jun. 19, 1995

[87] PCT Pub. No.: WO94/14692

PCT Pub. Date: Jul. 7, 1994

[30] Foreign Application Priority Data

Dec. 18, 1992 [DE] Germany ..... 42 42 885.8

[51] Int. Cl.[6] ..... B65H 29/20

[52] U.S. Cl. ..... 271/315

[58] Field of Search ..... 271/315, 187

[56] References Cited

U.S. PATENT DOCUMENTS

| | | | |
|---|---|---|---|
| 2,014,933 | 3/1933 | Harless et al. | 271/80 |
| 4,205,837 | 6/1980 | Hein et al. | 271/315 |
| 4,431,178 | 2/1984 | Kokubo et al. | 271/315 |
| 4,501,418 | 2/1985 | Ariga et al. | 271/315 |
| 4,861,019 | 8/1989 | Michalik | 271/315 |
| 4,971,303 | 11/1990 | Lange et al. | 270/60 |
| 5,028,045 | 7/1991 | Muller | 271/315 |
| 5,083,998 | 1/1992 | Carter | 271/315 |

FOREIGN PATENT DOCUMENTS

| | | |
|---|---|---|
| 0307889 | 9/1988 | European Pat. Off. . |
| 58-172152 | 10/1983 | Japan . |

*Primary Examiner*—William E. Terrell
*Assistant Examiner*—T. Kelly
*Attorney, Agent, or Firm*—Jones, Tullar & Cooper, P.C.

[57] ABSTRACT

A device for depositing folded products onto a conveyor belt utilizes a paddle wheel to receive the products from a folder. If the paddle wheel becomes overloaded, a guide device that has sheet metal guide plates is shifted away from the paddle wheel. This shifting is initiated automatically. The movement of the guide device creates a space or pocket for the accumulated folded products.

4 Claims, 2 Drawing Sheets

DEVICE FOR DEPOSITING PRODUCTS

FIELD OF THE INVENTION

The present invention relates to a device for depositing products. More particularly, the present invention is directed to a device for the overlapping deposit of folded products on a delivery belt which is provided with a guide assembly that will move to create additional space in case the products accumulate in the delivery device.

DESCRIPTION OF THE PRIOR ART

A device for the overlapping deposit of folded printed products is known from U.S. Pat. No. 2,014,933. The folded printed products are deposited by means of a paddle wheel onto a delivery belt which is located underneath the paddle wheel. A pivotable guide device is provided which, in case of an accumulation of folded printed products between the periphery of the paddle wheel and the guide device, is moved by the accumulating printed products in such a way that an overflow space can be formed. However, it is disadvantageous that this guide device can be disposed only at an end of a delivery belt. Because of this, the guide device pivots out of the conveying area of the delivery belt in case of an accumulation and the released accumulated printed products fall into empty space.

A device for the overlapping deposit of printed products onto a delivery belt located below a paddle wheel is provided with a guide assembly. This guide assembly can be moved away from the periphery of the paddle wheel in such a way that an overflow chamber is created between the periphery of the paddle wheel and the guide assembly. The guide assembly includes a plurality of sheet metal guide plates that extend along one side of the paddle wheel. These sheet metal guide plates are secured by suitable levers carried on pivot shafts. These levers and shafts form a frame that can be shifted away from the paddle wheel to create the overflow chamber.

The product delivery device in accordance with the present following advantages in particular are attained by the invention. Because the sheet metal guide plates of the guide device which is enclosing the paddle wheel on one side pivot away from the paddle wheel, an additional space for receiving the accumulated folded products is formed until such time as the machine can be stopped. Damage to the delivery belt located underneath the paddle wheel is prevented because the sheet metal guide plates pivot away along a curved path. In this way, it is possible to prevent damage to the tongues of the paddle wheel as well as to the sheet metal guide plates surrounding the paddle wheel and also as well to the conveyor belt for deposit.

BRIEF DESCRIPTION OF THE DRAWING

The invention will be explained in detail below by reference a preferred embodiment. The associated drawings show in.

DESCRIPTION OF THE PREFERRED EMBODIMENT

Figure 1:
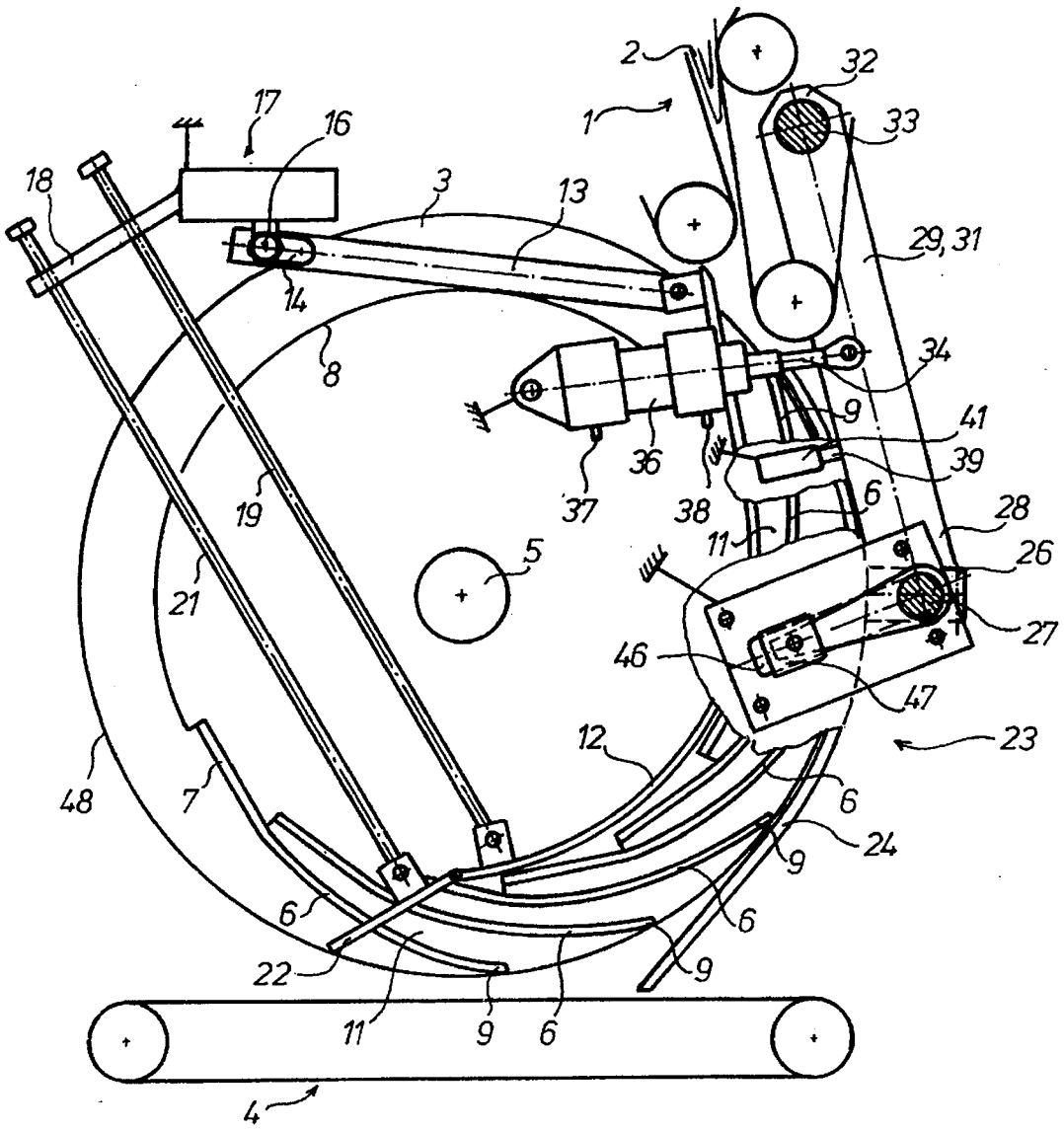
FIG. 1, a schematic side elevation view of the device in accordance with the present invention during normal production.

A paddle wheel, identified as a whole by 3, which deposits the folded products 2 in an overlapping manner on a delivery belt 4, is disposed below a conveyor guide, identified by 1 as a whole, which conveys folded products 2 from a folding, not shown.

On its periphery, the paddle wheel 3 has evenly disposed paddles 6, only a few of which are shown. A plurality of paddle wheels 3 are disposed on a driven shaft 5, spaced apart from each other and corresponding to the total width of the folded product. The paddles 6 are made of sheet metal strips, for example, each of whose first or inner end 7 is respectively frictionally and interlockingly connected with a base body 8 of the paddle wheel 3, and whose second or outer end 9 is respectively free-standing and forms, together with the adjoining blade 6, a pocket 11 for receiving and conveying the folded product 2. Adjustable braking devices in the form of tongues 12, which for example may be made of profiled steel, are disposed in the axial direction between the individual paddle wheels 3, and which brake the descent of the product 2 from the conveyor guide 1 to the bottom of the pocket 11.

A coupling link 13, is frictionally connected, by means of an elongated hole 14 located in its second end, to an adjusting device 17, formed by a threaded bolt fixed in the frame and a knurled nut 16. This coupling link 13 is hinged at its first end on the upper part of the tongue 12 that is facing the conveyor guide 1. A cross arm 18 with a threaded bore is fastened on the adjusting device 17 and receives two parallel extending threaded spindles 19, 21.

The first threaded spindle 19 is used for adjusting the lower end of the tongue 12 facing the delivery belt 4. The second threaded spindle 21 is used for adjusting a stripper 22 for products 2, with this stripper 22 being hinged on the lower end of the tongue 12. A guide device, identified as a whole by 23, for the ends of the products 2 is attached below the conveyor guide 1 and in the direction of rotation of the paddle wheel in a clockwise direction on one half of the periphery of the paddle wheel 3. This guide device 23 comprises sheet metal guide plates 24, extending in the peripheral direction of the paddle wheel 3 and arranged spaced apart and parallel with each other in the axial direction. These sheet metal guide plates 24 start below the conveyor guide 1 and terminate short of the delivery belt 4 and are clamped spaced apart from each other at approximately the midpoint of their length, for example on the horizontal plane of the shaft 5 of the paddle wheel 3, by means of a frictionally connected and interlocking clamping body 26 on a shaft 27 extending in an axially parallel direction.

The shaft 27 is seated with both its ends in first or lower ends 28 of levers 29, 31. The levers 29, 31 extend, starting at the shaft 27, tangentially with the paddle wheel 3 in the direction of the conveyor guide 1 disposed above the paddle wheel 3 and are frictionally connected by means of their second or upper ends 32 with a shaft 33, seated fixed in the machine frame. At least one lever 29 is hingedly connected, generally at its center between its first and second end 28, 32, with a piston rod 34 of a double-acting pneumatic work cylinder 36 fixed in the side frame.

The pneumatic work cylinder 36 is connected via connectors 37, 38 and valves, not shown, with a compressed air installation. In addition, during the normal production state of the device in accordance with FIG. 1, a contact 39 of a limit switch 41 fixed on the machine frame rests on the lever 29.

The shaft 27 supporting the sheet metal guide plates 24 is frictionally and interlockingly connected by at least one of its outer ends with a first or outer end 42 of a lever arm 43, whose second or inner end 44 is interlockingly guided in a closed cam 46 which is in the form of a groove. This second or inner end 44 of the lever 43 is hingedly connected with a sliding block 47 that is constrained to move linearly in the cam 46 and which is made of a material with low coefficients of friction.

Figure 2:
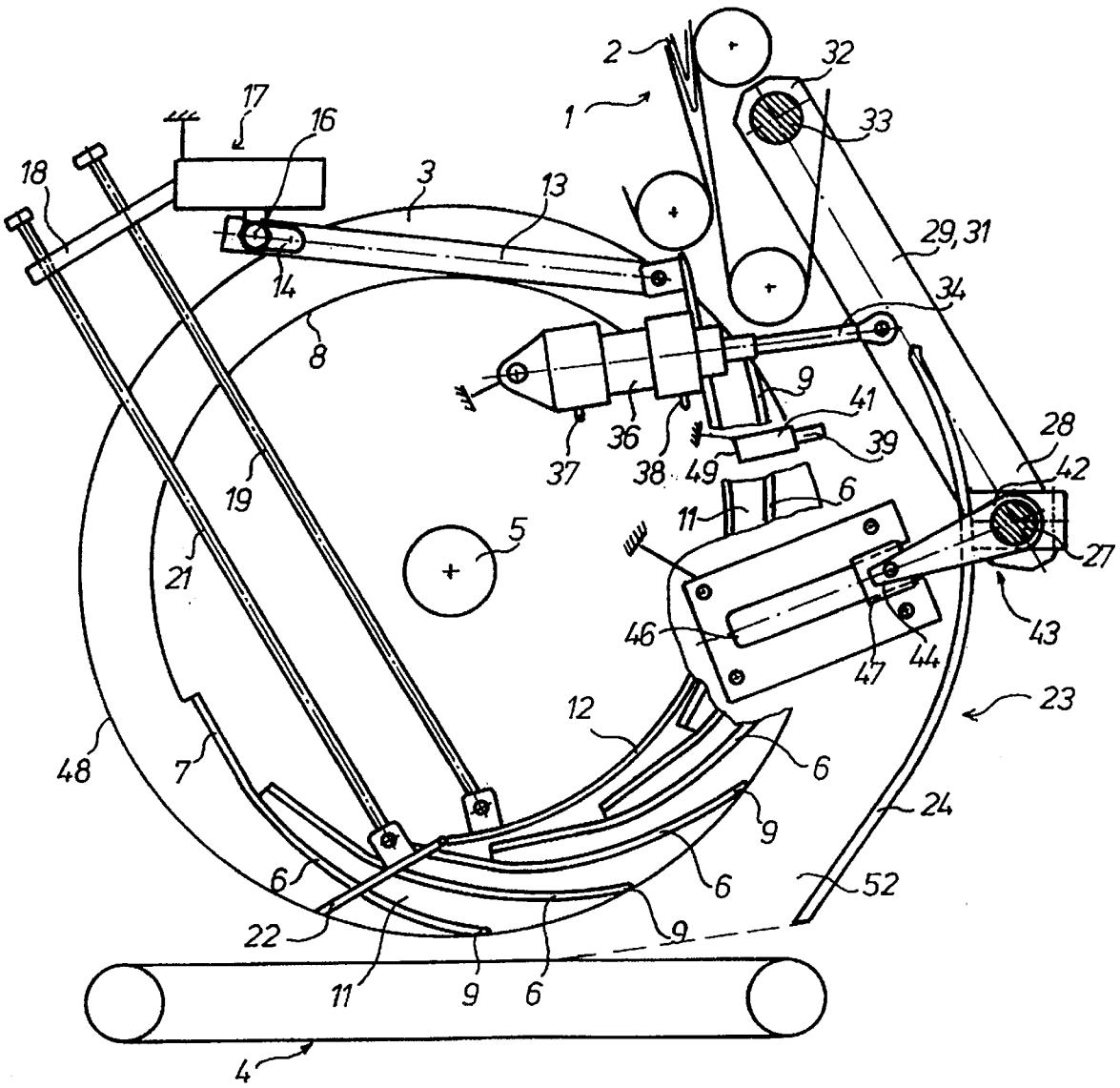
FIG. 2, a representation corresponding to FIG. 1, but with the sheet metal guide plates pivoted out in case of a failure.

When so-called "stoppers" occur, several folded products 2 will simultaneously get into the area of one or more of the pockets 11 formed by the paddles 6 or in the area between the sheet metal guide plates 24 and the paddles 6. These "stoppers" will cause the sheet metal guide plates 24, connected by means of the shaft 27, to move away from the periphery 48 of the paddle wheel 3. This occurs because the first or lower end 28 of the lever 29, 31, which is rotatably fastened with its second or upper end 32 on the shaft 33, pivots away from the paddle wheel 3 so that the contact 39 of the limit switch 41 comes out of contact with the lever 29. The limit switch 41 reports a disruption via a cable connection, so that the work cylinder 36 will be charged with compressed air, causing its piston rod 34 to be extended. This way, the lever 29, 31 is pivoted away from the periphery 48 of the paddle wheel 3 around the shaft 33 which acts as the fulcrum. By means of this, the sheet metal guide plates 24, which are frictionally and interlockingly connected with the shaft 27, are brought into the failure position in accordance with the depiction of FIG. 2, so that the accumulated products 2 can fall into an empty space 52 in the approximate shape of a basket which has now been created. As as a result, the paddles 6 of the paddle wheel 3, as well as the adjoining conveying installations 1, 4, are not damaged. The connection between the lever 43, fastened frictionally connected on the shaft 27 and the cam 46 fixed on the frame and extending obliquely toward the top in a direction distant from the periphery as well as linearly, assure that in case of a failure, the ends 51 of the sheet metal guide plates 24 facing the delivery belt 4 are immediately lifted obliquely toward the top in the direction of the cam 46 and that therefore the delivery belt 4 cannot be damaged.

While a preferred embodiment of a device for depositing folded products on a delivery belt in accordance with the present invention has been set forth fully and completely hereinabove, it will be apparent to one of skill in the art that a number of changes can be made without departing from the true spirit and scope of the present invention which is accordingly to be limited only by the following claims.

I claim:

1. A product delivery device usable for the deposit of folded printed products on a delivery belt comprising:

a paddle wheel having a plurality of paddles having outer ends defining a peripheral surface of said paddle wheel, said paddle wheel being rotatably supported in a frame above said delivery belt to receive said folded products and to deposit said folded products on said delivery belt;

a guide device having a plurality of guide plates extending outwardly forward peripheral surface of said paddle wheel and spaced from said outer ends of said paddles;

spaced levers extending generally tangentially to said periphery of said paddle wheel and having first ends pivotable about a first shaft secured to said frame, and second ends secured to a second shaft which is pivotably secured to said guide plates;

a lever arm having an outer end secured to said second shaft; and a cam secured to said frame and supporting a sliding block, said lever arm having an inner end secured to said sliding block, said guide device being movable away from said peripheral surface of said paddle wheel in response to an accumulation of said folded products in said paddle wheel to form an overflow chamber between said guide device and said peripheral surface of said paddle wheel.

2. The product delivery device of claim 1 wherein said cam is a linearly extending groove.

3. The product delivery device of claim 1 further including a working cylinder having a cylinder end secured to said frame and having an extendable piston rod secured to one of said spaced levers and usable to move said guide device with respect to said paddle wheel.

4. The product delivery device of claim 3 further including a limit switch engageable by said guide device, said limit switch being operated to actuate said working cylinder as said guide device is moved away from said peripheral surface of said paddle wheels in response to said accumulation of said folded products in said paddle wheel.

* * * * *